US008114254B2

(12) United States Patent
Quigley

(10) Patent No.: US 8,114,254 B2
(45) Date of Patent: Feb. 14, 2012

(54) STRUCTURED FORMING FABRIC, PAPERMAKING MACHINE, AND METHOD

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 631 days.

(21) Appl. No.: 12/182,773

(22) Filed: Jul. 30, 2008

(65) Prior Publication Data

US 2010/0024912 A1 Feb. 4, 2010

(51) Int. Cl.
*D21F 1/10* (2006.01)
*D03D 25/00* (2006.01)

(52) U.S. Cl. ..... 162/348; 162/903; 139/383 A

(58) Field of Classification Search ..... 162/348, 162/902, 903, 904, 116, 362; 139/383 A, 139/425 A See application file for complete search history.

(56) References Cited

U.S. PATENT DOCUMENTS

| | | | | |
|---|---|---|---|---|
| 4,191,609 | A * | 3/1980 | Trokhan | 162/113 |
| 5,429,686 | A | 7/1995 | Chiu et al. | |
| 6,237,644 | B1 | 5/2001 | Hay et al. | |
| 6,592,714 | B2 | 7/2003 | Lamb | |
| 6,649,026 | B2 | 11/2003 | Lamb | |
| 7,585,395 | B2 | 9/2009 | Quigley et al. | |
| 2008/0236699 | A1 * | 10/2008 | Kroll et al. | 139/383 A |

FOREIGN PATENT DOCUMENTS

| | | |
|---|---|---|
| WO | 2005035867 | 4/2005 |
| WO | 2005075732 | 8/2005 |
| WO | 2005075737 | 8/2005 |
| WO | 2006113818 | 10/2006 |

* cited by examiner

*Primary Examiner* — Eric Hug
(74) *Attorney, Agent, or Firm* — Quarles & Brady LLP

(57) ABSTRACT

The present invention provides a fabric for a papermaking machine. The fabric includes a machine facing side and a web facing side having pockets formed by warp and weft yarns. Each pocket is defined by four sides on the web facing side, three of the four sides each being formed by a knuckle of a single yarn, and one of the sides being formed by a knuckle of a weft and of a warp yarn, wherein the weft yarn also defines a bottom surface of the pocket.

19 Claims, 8 Drawing Sheets

STRUCTURED FORMING FABRIC, PAPERMAKING MACHINE, AND METHOD

CROSS-REFERENCE TO RELATED APPLICATION

Not applicable.

STATEMENT CONCERNING FEDERALLY SPONSORED RESEARCH OR DEVELOPMENT

Not applicable.

FIELD OF THE INVENTION

The present invention relates generally to papermaking, and relates more specifically to a structured forming fabric employed in papermaking. The invention also relates to a structured forming fabric having deep pockets.

BACKGROUND OF THE INVENTION

In the conventional Fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermakers' fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermakers' fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and the like) the papermaking surface comprises a very finely woven or fine wire mesh structure.

In a conventional tissue forming machine, the sheet is formed flat. At the press section, 100% of the sheet is pressed and compacted to reach the necessary dryness and the sheet is further dried on a Yankee and hood section. This, however, destroys the sheet quality. The sheet is then creped and wound-up, thereby producing a flat sheet.

In an ATMOS™ system, a sheet is formed on a structured or molding fabric and the sheet is further sandwiched between the structured or molding fabric and a dewatering fabric. The sheet is dewatered through the dewatering fabric and opposite the molding fabric. The dewatering takes place with air flow and mechanical pressure. The mechanical pressure is created by a permeable belt and the direction of air flow is from the permeable belt to the dewatering fabric. This can occur when the sandwich passes through an extended pressure nip formed by a vacuum roll and the permeable belt. The sheet is then transferred to a Yankee by a press nip. Only about 25% of the sheet is slightly pressed by the Yankee while approximately 75% of the sheet remains unpressed for quality. The sheet is dried by a Yankee/Hood dryer arrangement and then dry creped. In the ATMOS™ system, one and the same structured fabric is used to carry the sheet from the headbox to the Yankee dryer. Using the ATMOS™ system, the sheet reaches between about 35 to 38% dryness after the ATMOS™ roll, which is almost the same dryness as a conventional press section. However, this advantageously occurs with almost 40 times lower nip pressure and without compacting and destroying sheet quality. Furthermore, a big advantage of the ATMOS™ system is that it utilizes a permeable belt which is highly tensioned, e.g., about 60 kN/m. This belt enhances the contact points and intimacy for maximum vacuum dewatering. Additionally, the belt nip is more than 20 times longer than a conventional press and utilizes air flow through the nip, which is not the case on a conventional press system.

Actual results from trials using an ATMOS™ system have shown that the caliper and bulk of the sheet is 30% higher than the conventional through-air drying (TAD) formed towel fabrics. Absorbency capacity is also 30% higher than with conventional TAD formed towel fabrics. The results are the same whether one uses 100% virgin pulp up to 100% recycled pulp. Sheets can be produced with basis weight ratios of between 14 to 40 g/m$^2$. The ATMOS™ system also provides excellent sheet transfer to the Yankee working at 33 to 37% dryness. There is essentially no dryness loss with the ATMOS™ system since the fabric has square valleys and not square knuckles (peaks). As such, there is no loss of intimacy between the dewatering fabric, the sheet, the molding fabric, and the belt. A key aspect of the ATMOS™ system is that it forms the sheet on the molding fabric and the same molding fabric carries the sheet from the headbox to the Yankee dryer. This produces a sheet with a uniform and defined pore size for maximum absorbency capacity.

U.S. patent application Ser. No. 11/753,435 filed on May 24, 2007, the disclosure of which is hereby expressly incorporated by reference in its entirety, discloses a structured forming fabric for an ATMOS™ system. The fabric utilizes an at least three float warp and weft structure which, like the prior art fabrics, is symmetrical in form.

U.S. Pat. No. 5,429,686 to Chiu et al., the disclosure of which is hereby expressly incorporated by reference in its entirety, discloses structured forming fabrics which utilize a load-bearing layer and a sculptured layer. The fabrics utilize impression knuckles to imprint the sheet and increase its surface contour. This document, however, does not create pillows in the sheet for effective dewatering of TAD applications, nor does it teach using the disclosed fabrics on an ATMOS™ system and/or forming the pillows in the sheet while the sheet is relatively wet and utilizing a hi-tension press nip.

U.S. Pat. No. 6,237,644 to Hay et al., the disclosure of which is hereby expressly incorporated by reference in its entirety, discloses structured forming fabrics which utilize a lattice weave pattern of at least three yarns oriented in both warp and weft directions. The fabric essentially produces shallow craters in distinct patterns. This document, however, does not create deep pockets which have a three-dimensional pattern, nor does it teach using the disclosed fabrics on an ATMOS™ system and/or forming the pillows in the sheet while the sheet is relatively wet and utilizing a hi-tension press nip.

International Publication No. WO 2005/035867 to LaFond et al., the disclosure of which is hereby expressly incorporated by reference in its entirety, discloses structured forming fabrics which utilize at least two different diameter yarns to impart bulk into a tissue sheet. This document, however, does not create deep pockets which have a three-dimensional pattern. Nor does it teach using the disclosed fabrics on an ATMOS™ system and/or forming the pillows in the sheet while the sheet is relatively wet and utilizing a hi-tension press nip.

U.S. Pat. No. 6,592,714 to Lamb, the disclosure of which is hereby expressly incorporated by reference in its entirety, discloses structured forming fabrics which utilize deep pockets and a measurement system. However, it is not apparent that the disclosed measurement system is replicatable. Furthermore, Lamb relies on the aspect ratio of the weave design to achieve the deep pockets. This document also does not teach using the disclosed fabrics on an ATMOS™ system and/or forming the pillows in the sheet while the sheet is relatively wet and utilizing a hi-tension press nip.

U.S. Pat. No. 6,649,026 to Lamb, the disclosure of which is hereby expressly incorporated by reference in its entirety, discloses structured forming fabrics which utilize pockets based on five-shaft designs and with a float of three yarns in both warp and weft directions (or variations thereof). The fabric is then sanded. However, Lamb does not teach an asymmetrical weave pattern. This document also does not teach using the disclosed fabrics on an ATMOS™ system and/or forming the pillows in the sheet while the sheet is relatively wet and utilizing a hi-tension press nip.

International Publication No. WO 2006/113818 to Kroll et al., the disclosure of which is hereby expressly incorporated by reference in its entirety, discloses structured forming fabrics which utilize a series of two alternating deep pockets for TAD applications. However, Kroll does not teach to utilize one consistent sized pocket in order to provide effective and consistent dewatering and would not produce a regular sheet finish on the finished product. Kroll also does not teach an asymmetrical weave pattern. This document also does not teach using the disclosed fabrics on an ATMOS™ system and/or forming the pillows in the sheet while the sheet is relatively wet and utilizing a hi-tension press nip.

International Publication No. WO 2005/075737 to Herman et al. and U.S. patent application Ser. No. 11/380,826 filed on Apr. 28, 2006, the disclosures of which are hereby expressly incorporated by reference in their entireties, disclose structured molding fabrics for an ATMOS™ system which can create a more three-dimensionally oriented sheet. These documents, however, do not teach, among other things, the deep pocket weaves according to the invention.

International Publication No. WO 2005/075732 to Scherb et al., the disclosure of which is hereby expressly incorporated by reference in its entirety, discloses a belt press utilizing a permeable belt in a paper machine which manufactures tissue or toweling. According to this document, the web is dried in a more efficient manner than has been the case in prior art machines such as TAD machines. The formed web is passed through similarly open fabrics and hot air is blown from one side of the sheet through the web to the other side of the sheet. A dewatering fabric is also utilized. Such an arrangement places great demands on the forming fabric because of the pressure applied by the belt press and hot air is blown through the web in the belt press. However, this document does not teach, among other things, the deep pocket weaves according to the invention.

The above-noted conventional fabrics limit the amount of bulk that can be built into the sheet being formed due to the fact that they have shallow depth pockets compared to the present invention. Furthermore, the pockets of the conventional fabrics are merely extensions of the contact areas on the warp and weft yarns.

SUMMARY OF THE INVENTION

In one aspect, the invention provides a fabric for a papermaking machine that includes a machine facing side and a web facing side having pockets formed by warp and weft yarns. Each pocket is defined by four sides on the web facing side, three of the four sides each being formed by a knuckle of a single yarn, and one of the sides being formed by a knuckle of a weft and of a warp yarn, wherein the weft yarn also defines a bottom surface of the pocket.

In another aspect, the invention provides a fabric for a papermaking machine that includes a machine facing side and a web facing side comprising pockets formed by warp and weft yarns. Each pocket is defined by four sides on the web facing side. The first side is a weft knuckle that passes over five consecutive warp yarns. The second side is a warp knuckle of the fourth warp yarn passed over by the first side. The third side is a weft knuckle that passes over five consecutive warp yarns and the second side is of the third warp yarn passed over by the third side. The fourth side is a warp knuckle of the first warp yarn passed over by the first side and a weft knuckle of a weft yarn that also defines a bottom surface of the pocket.

In another aspect, the invention provides a papermaking machine that includes a vacuum roll having an exterior surface and a dewatering fabric having first and second sides. The dewatering fabric is guided over a portion of the exterior surface of the vacuum roll, and the first side is in at least partial contact with the exterior surface of the vacuum roll. The papermaking machine also includes a structured fabric that has a machine facing side and a web facing side having pockets formed by warp and weft yarns. Each pocket is defined by four sides on the web facing side, three of the four sides each being formed by a knuckle of a single yarn, and one of the sides being formed by a knuckle of a weft and of a warp yarn, wherein the weft yarn also defines a bottom surface of the pocket. The dewatering fabric is positioned between the vacuum roll and the structured fabric.

In another aspect, the invention provides a papermaking machine that includes a Yankee dryer and at least one structured fabric. The structured fabric includes a machine facing side and a web facing side having pockets formed by warp and weft yarns. Each pocket is defined by four sides on the web facing side, three of the four sides each being formed by a knuckle of a single yarn, and one of the sides being formed by a knuckle of a weft and of a warp yarn, wherein the weft yarn also defines a bottom surface of the pocket. The structured fabric conveys a fibrous web to the Yankee dryer.

In another aspect, the invention provides methods of using a structured forming fabric of the invention in TAD, ATMOS™, and E-TAD papermaking systems.

The foregoing and other objects and advantages of the invention will be apparent in the detailed description and drawings which follow. In the description, reference is made to the accompanying drawings which illustrate a preferred embodiment of the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, and the description is taken with the drawings making apparent to those skilled in the art how the forms of the present invention may be embodied in practice.

The present invention relates to a structured fabric for a papermaking machine, a former for manufacturing premium tissue and toweling, and also to a former which utilizes the structured fabric, and in some embodiments a belt press, in a papermaking machine. The present invention relates to a twin wire former for manufacturing premium tissue and toweling which utilizes the structured fabric and a belt press in a papermaking machine. The system of the invention is capable of producing premium tissue or toweling with a quality similar to a through-air drying (TAD) but with a significant cost savings.

The present invention also relates to a twin wire former ATMOS™ system which utilizes the structured fabric which has good resistance to pressure and excessive tensile strain forces, and which can withstand wear/hydrolysis effects that are experienced in an ATMOS™ system. The system may also include a permeable belt for use in a high tension extended nip around a rotating roll or a stationary shoe and a dewatering fabric for the manufacture of premium tissue or towel grades. The fabric has key parameters which include permeability, weight, caliper, and certain compressibility.

Figure 1:
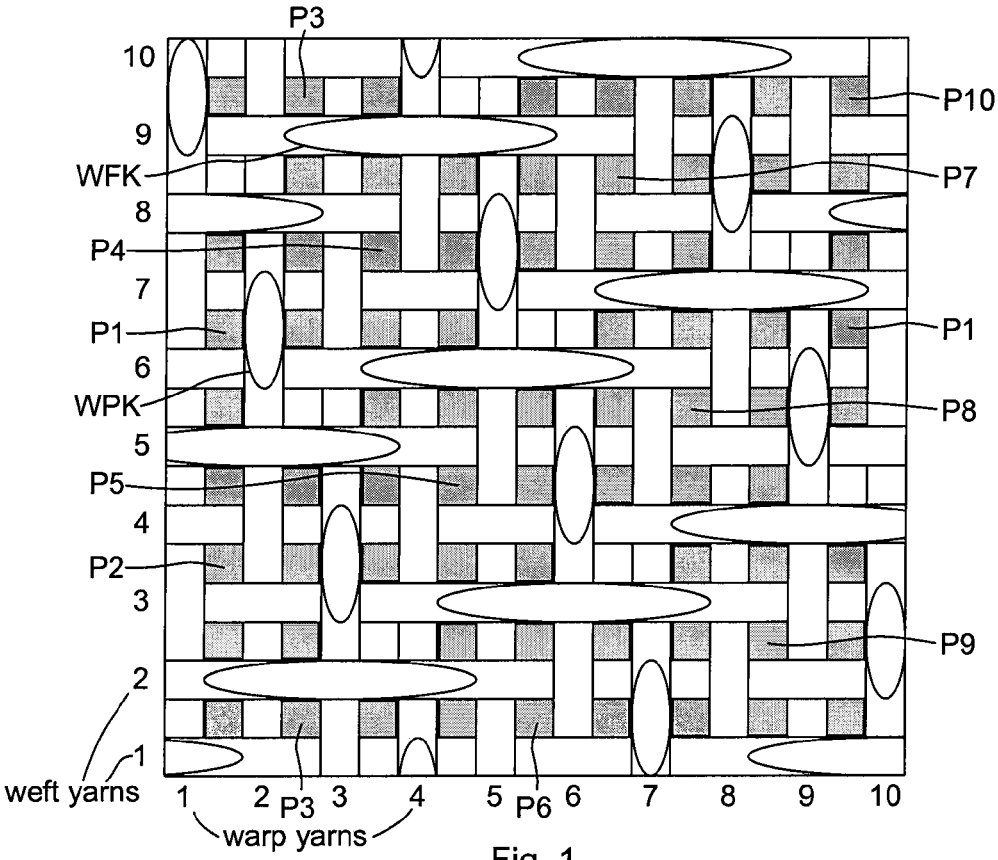
FIG. 1 shows a weave pattern of a top side or paper facing side of an embodiment of a structured fabric according to the invention.
Figure 2:
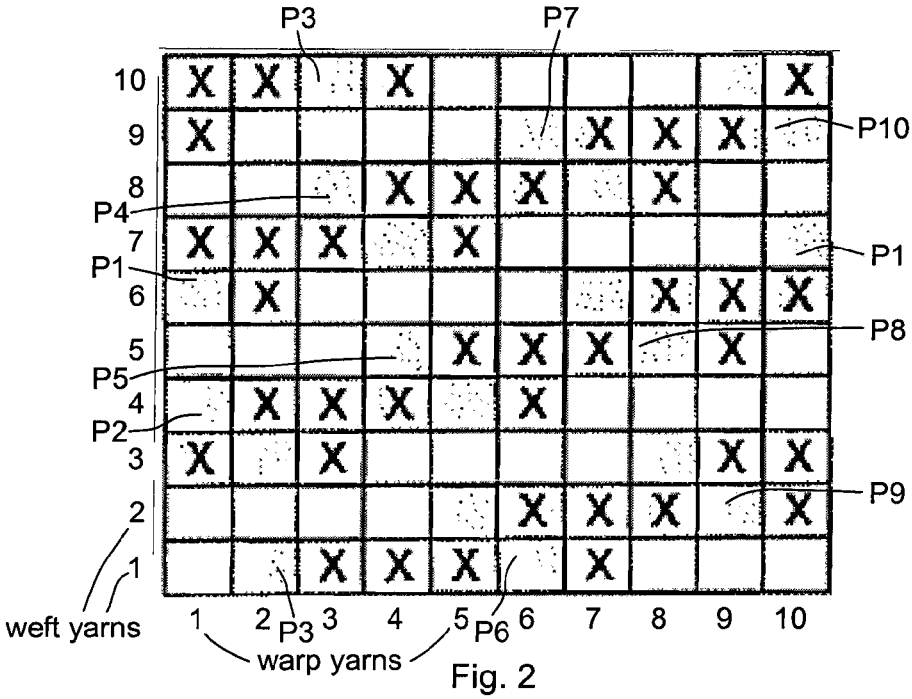
FIG. 2 shows the repeating pattern square of the structured fabric of FIG. 1. Each 'X' indicates a location where a warp yarn passes over a weft yarn.
Figure 3:
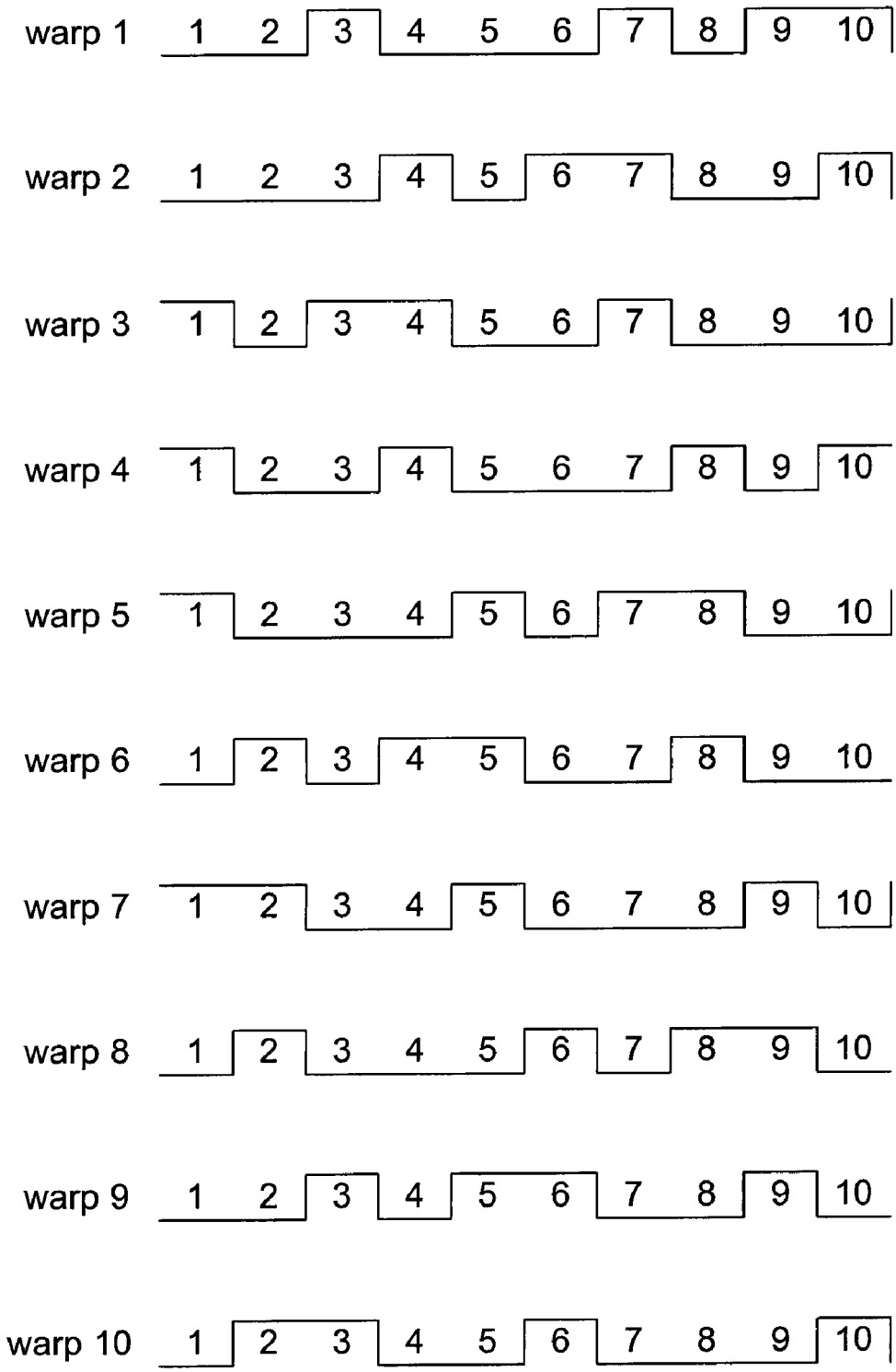
FIG. 3 is a schematic representation of the weave pattern of the structured fabric shown in FIG. 1, and illustrates how each of the ten warp yarns weaves with the ten weft yarns in one repeat. Stippled areas of the pattern square represent pockets.

A first non-limiting embodiment of the structured fabric of the present invention is illustrated in FIGS. 1-3. FIG. 1 depicts a top pattern view of the web facing side of the fabric (i.e., a view of the papermaking surface). The numbers 1-10 shown on the bottom of the pattern identify the warp (machine direction) yarns while the left side numbers 1-10 show the weft (cross-direction) yarns. In FIG. 2, symbol X illustrates a location where a warp yarn passes over a weft yarn and an empty box illustrates a location where a warp yarn passes under a weft yarn. As shown in FIG. 1, the areas formed between warp yarns 3 and 6, and between weft yarns 3, 5, and 6, as well as other areas, define pocket areas P1-P10 that form a pillow in a web or sheet. The shaded areas indicate the locations of the pockets. The sides of each pocket are defined by one warp knuckle WPK, two weft knuckles WFK, and one knuckle of a weft and of a warp yarn.

The embodiment shown in FIGS. 1-3 results in deep pockets formed in the fabric whose bottom surface is formed by two warp yarns (e.g., warp yarns 4 and 5 for pocket P5) and two weft yarns (e.g., weft yarns 4 and 5 for pocket P5) and the nine spaces adjacent to these yarns. In the pocket, one of the warp yarns passes over a first of the weft yarns and under a second of the weft yarns (e.g., warp yarn 4 passes over weft yarn 4 and under weft yarn 5). Another of the warp yarns passes under the first of the weft yarns and over the second of the weft yarns (e.g., warp yarn 5 passes under weft yarn 4 and over weft yarn 5). As shown in FIG. 1, the repeating pattern square of the fabric includes an upper plane having warp and weft knuckles that define sides for the pockets. Pockets P1-P10 are formed in a lower plane the fabric.

The fabric of FIG. 1 shows a single repeating pattern square of the fabric that encompasses ten warp yarns (yarns 1-10 extend vertically in FIG. 1) and ten weft yarns (yarns 1-10 extend horizontally in FIG. 1). The fabric can be a ten shed dsp. FIG. 3 depicts the paths of warp yarns 1-10 as they weave with weft yarns 1-10. While FIGS. 1-3 only show a single section of the fabric, those of skill in the art will appreciate that in commercial applications the pattern shown in FIGS. 1-3 would be repeated many times, in both the warp and weft directions, to form a large fabric suitable for use on a papermaking machine.

As seen in FIG. 1, warp yarn 1 weaves with weft yarns 1-10 by passing over weft yarns 3, 7, 9, and 10 and passing under weft yarns 1, 2, 4, 5, 6, and 8. That is, warp yarn 1 passes under weft yarns 1 and 2, then over weft yarn 3, then under weft yarns 4-6, then over weft yarn 7, then under weft yarn 8, and then over weft yarns 9 and 10. In the area where warp yarn 1 weaves with, e.g., weft yarns 6 and 7, a portion of pocket P1 is formed. In the area where warp yarn 1 weaves with, e.g., weft yarns 3 and 4, a portion of pocket P2 is formed. Furthermore, a warp knuckle WPK is formed where warp yarn 1 passes over weft yarns 9 and 10. Weft knuckles WFK are formed in the areas where weft yarns 1, 2, 4, 5, and 8 pass over warp yarn 1 and pass over five consecutive warp yarns. A knuckle is formed in the area where warp yarn 1 weaves with weft yarns 1 and 10 that defines a side of pocket P3.

Warp yarn 2 weaves with weft yarns 1-10 by passing over weft yarns 4, 6, 7, and 10 and passing under weft yarns 1-3, 5, 8, and 9. That is, warp yarn 2 passes under weft yarns 1-3, then over weft yarn 4, then under weft yarn 5, then over weft yarns 6 and 7, then under weft yarns 8 and 9, and then over weft yarn 10. In the area where warp yarn 2 weaves with, e.g., weft yarns 3 and 4, a portion of pocket P2 is formed. In the areas where warp yarn 2 weaves with, e.g., weft yarns 1 and 10, portions of pocket P3 are formed. A warp knuckle WPK is formed where warp yarn 2 passes over weft yarns 6 and 7. Weft knuckles WFK are formed in the areas where weft yarns 1, 2, 5, 8, and 9 pass over warp yarn 2 and pass over five consecutive warp yarns. A knuckle is formed in the area where warp yarn 2 weaves with weft yarns 7 and 8 that defines a side of pocket P4.

Again with reference to FIG. 3, warp yarn 3 weaves with weft yarns 1-10 by passing over weft yarns 1, 3, 4, and 7 and passing under weft yarns 2, 5, 6, and 8-10. That is, warp yarn 3 passes over weft yarn 1, then under weft yarn 2, then over weft yarns 3 and 4, then under weft yarns 5 and 6, then over weft yarn 7, and then under weft yarns 8-10. In the areas where warp yarn 3 weaves with, e.g., weft yarns 1 and 10, portions of pocket P3 are formed. In the area where warp yarn 3 weaves with, e.g., weft yarns 7 and 8, a portion of pocket P4 is formed. Furthermore, a warp knuckle WPK is formed where warp yarn 3 passes over weft yarns 3 and 4. Weft knuckles WFK are formed in the areas where weft yarns 2, 5, 6, 8, and 9 pass over warp yarn 3 and pass over five consecutive warp yarns. A knuckle is formed in the area where warp yarn 3 weaves with weft yarns 4 and 5 that defines a side of pocket P5.

Warp yarn 4 weaves with weft yarns 1-10 by passing over weft yarns 1, 4, 8, and 10 and passing under weft yarns 2, 3, 5-7, and 9. That is, warp yarn 4 passes over weft yarn 1, then under weft yarns 2 and 3, then over weft yarn 4, then under weft yarns 5-7, then over weft yarn 8, then under weft yarn 9, and then over weft yarn 10. In the area where warp yarn 4 weaves with, e.g., weft yarns 7 and 8, a portion of pocket P4 is formed. In the area where warp yarn 4 weaves with, e.g., weft yarns 4 and 5, a portion of pocket P5 is formed. Furthermore, portions of warp knuckles WPK are formed near ends of the pattern square, e.g. where warp yarn 4 passes over weft yarns 1 and 10. Weft knuckles WFK are formed in the areas where weft yarns 2, 3, 5, 6, and 9 pass over warp yarn 4 and pass over five consecutive warp yarns. A knuckle is formed in the area where warp yarn 4 weaves with weft yarns 1 and 2 that defines a side of pocket P6.

Again with reference to FIG. 3, warp yarn 5 weaves with weft yarns 1-10 by passing over weft yarns 1, 5, 7, and 8 and by passing under weft yarns 2-4, 6, 9, and 10. That is, warp yarn 5 first passes over weft yarn 1, then under weft yarns 2-4, then over weft yarn 5, then under weft yarn 6, then over weft yarns 7 and 8, and then under weft yarns 9 and 10. In the area where warp yarn 5 weaves with, e.g., weft yarns 4 and 5, a portion of pocket P5 is formed. In the area where warp yarn 5 weaves with, e.g., weft yarns 1 and 2, a portion of pocket P6 is formed. A warp knuckle WPK is formed where warp yarn 5 passes over weft yarns 7 and 8. Weft knuckles WFK are formed in the areas where weft yarns 2, 3, 6, 9, and 10 pass over warp yarn 5 and pass over five consecutive warp yarns. A knuckle is formed in the area where warp yarn 5 weaves with weft yarns 8 and 9 that defines a side of pocket P7.

Warp yarn 6 weaves with weft yarns 1-10 by passing over weft yarns 2, 4, 5, and 8 and passing under weft yarns 1, 3, 6, 7, 9 and 10. That is, warp yarn 6 passes under weft yarn 1, then over weft yarn 2, then under weft yarn 3, then over weft yarns 4 and 5, then under weft yarns 6 and 7, then over weft yarn 8, and then under weft yarns 9 and 10. In the area where the warp yarn 6 weaves with, e.g., weft yarns 1 and 2, a portion of pocket P6 is formed. In the area where warp yarn 6 weaves with, e.g., weft yarns 8 and 9, a portion of pocket P7 is formed. A warp knuckle WPK is formed where warp yarn 6 passes over weft yarns 4 and 5. Weft knuckles WFK are formed in the areas where weft yarns 3, 6, 7, 9, and 10 pass over warp yarn 6 and pass over five consecutive warp yarns. A knuckle is formed in the area where warp yarn 6 weaves with weft yarns 5 and 6 that defines a side of pocket P8.

Again with reference to FIG. 3, warp yarn 7 weaves with weft yarns 1-10 by passing over weft yarns 1, 2, 5, and 9 and by passing under weft yarns 3, 4, 6, 7, 8, and 10. That is, warp yarn 7 first passes over weft yarns 1 and 2, then under weft yarns 3 and 4, then over weft yarn 5, then under weft yarns 6-8, then over weft yarn 9, and then under weft yarn 10. In the area where warp yarn 7 weaves with, e.g., weft yarns 8 and 9, a portion of pocket P7 is formed. In the area where warp yarn 7 weaves with, e.g., weft yarns 5 and 6, a portion of pocket P8 is formed. A warp knuckle WPK is formed in the area where warp yarn 7 passes over weft yarns 1 and 2. Weft knuckles WFK are formed in the areas where weft yarns 3, 4, 6, 7, and 10 pass over warp yarn 7 and pass over three consecutive warp yarns. A knuckle is formed in the area where warp yarn 7 weaves with weft yarns 2 and 3 that defines a side of pocket P9.

Warp yarn 8 weaves with weft yarns 1-10 by passing over weft yarns 2, 6, 8 and 9 and passing under weft yarns 1, 3-5, 7, and 10. That is, warp yarn 8 passes under weft yarn 1, then over weft yarn 2, then under weft yarns 3-5, then over weft yarn 6, then under weft yarn 7, then over weft yarns 8 and 9, and then under weft yarn 10. In the area where warp yarn 8 weaves with, e.g., weft yarns 5 and 6, a portion of pocket P8 is formed. In the area where warp yarn 8 weaves with, e.g., weft yarns 2 and 3, a portion of pocket P9 is formed. A warp knuckle WPK is formed in the area where warp yarn 8 passes over weft yarns 8 and 9. Weft knuckles WFK are formed in the areas where the weft yarns 1, 3, 4, 7, and 10 pass over warp yarn 8 and pass over five consecutive warp yarns. A knuckle is formed in the area where warp yarn 8 weaves with weft yarns 9 and 10 that defines a side of pocket P10.

Again with reference to FIG. 3, warp yarn 9 weaves with weft yarns 1-10 by passing over weft yarns 3, 5, 6, and 9 and passing under weft yarns 1, 2, 4, 7, 8, and 10. That is, warp yarn 9 passes under weft yarns 1 and 2, then over weft yarn 3, then under weft yarn 4, then over weft yarns 5 and 6, then under weft yarns 7 and 8, then over weft yarn 9, and then under weft yarn 10. In the area where the warp yarn 9 weaves with, e.g., weft yarns 2 and 3, a portion of pocket P9 is formed. In the area where warp yarn 9 weaves with, e.g., weft yarns 9 and 10, a portion of pocket P10 is formed. Furthermore, a warp knuckle WPK is formed in the area where the warp yarn 9 passes over weft yarns 5 and 6. Weft knuckles WFK are formed in the areas where weft yarns 1, 4, 7, 8, and 10 pass over warp yarn 9 and pass over five consecutive warp yarns. A knuckle is formed in the area where warp yarn 9 weaves with weft yarns 6 and 7 that defines a side of pocket P1.

Finally, warp yarn 10 weaves with weft yarns 1-10 by passing over weft yarns 2, 3, 6, and 10 and passing under weft yarns 1, 4, 5, and 7-9. That is, warp yarn 10 passes under weft yarn 1, then over weft yarns 2 and 3, then under weft yarns 4 and 5, then over weft yarn 6, then under weft yarns 7-9, and then over weft yarn 10. In the area where warp yarn 10 weaves with weft yarns 9 and 10, a portion of pocket P10 is formed. In the area where warp yarn 10 weaves with, e.g., weft yarns 6 and 7, a portion of pocket P1 is formed. A warp knuckle WPK is formed in the area where warp yarn 10 passes over weft yarns 2 and 3. Weft knuckles WFK are formed in the areas where weft yarns 1, 4, 5, 7, and 8 pass over warp yarn 10 and pass over five consecutive warp yarns. A knuckle is formed in the area where warp yarn 10 weaves with weft yarns 3 and 4 that defines a side of pocket P2.

Each warp yarn weaves with the weft yarns in an identical pattern; that is, each warp yarn passes under two weft yarns, then over one weft yarn, then under three weft yarns, then over one weft yarn, then under one weft yarn, and then over two weft yarns. In addition, this pattern between adjacent warp yarns is offset by seven weft yarns. For example, the one weft yarn passed under (besides the sets of consecutive weft yarns passed under) by warp yarn 3 is weft yarn 2. The one weft yarn passed under by warp yarn 4 is weft yarn 9. Also, each weft yarn weaves with the warp yarns in an identical pattern; that is, each weft yarn passes over five warp yarns, then under three warp yarns, then over one warp yarn, and then under one warp yarn. This pattern between adjacent weft yarns is offset by three warp yarns. For example, the one warp yarn passed over (besides the five consecutive warp yarns passed over) by weft yarn 6 is warp yarn 1. The one warp yarn passed over by weft yarn 7 is warp yarn 4.

As discussed above, the yarns define areas in which pockets are formed. Due to the offset of the weave pattern between warp yarns as discussed in the previous paragraph, similar portions of each pocket defined by adjacent warp yarns are also offset from each other by seven weft yarns. For example, a right side of pocket P6 is defined in the area where warp yarn 7 intersects with weft yarns 1 and 2. A right side of pocket P7 is defined in the area where warp yarn 8 intersects with weft yarns 8 and 9.

Each pocket is defined by four sides. One of the sides is defined by a warp knuckle WPK that crosses two weft yarns. Two sides are defined by weft knuckles WFK, each of which crosses five warp yarns. The other side is defined by a knuckle of a weft and of a warp yarn, and the weft yarn also defines a bottom surface of the pocket. In addition, each warp knuckle WPK and weft knuckle WFK defines a side of more than one pocket. For example, warp knuckle WPK of warp yarn 5 defines sides of pockets P4 and P7. Similarly, weft knuckle WFK of weft yarn 6 defines sides of pockets P4, P5, and P8. Specifically, weft knuckle WFK of weft yarn 6 defines a lower side of pocket P4 where it passes over warp yarns 3 and 4, an upper side of pocket P5 where it passes over warp yarns 4 and 5, and a side of pocket P8 where it passes over warp yarn 6.

Each pocket is defined by a warp knuckle WPK that passes over an end of a weft knuckle WFK and has an end that is passed over by a weft knuckle WFK. For example, for pocket P5, the warp knuckle WPK of warp yarn 3 passes over an end of the weft knuckle WFK of weft yarn 3 and has an end that is passed over by the weft knuckle WFK of weft yarn 5. Each pocket is also defined by a warp knuckle WPK that has two ends that are passed over by weft knuckles WFK. For example, for pocket P5, the warp knuckle WPK of warp yarn 6 has ends that are passed over by the weft knuckles WFK of weft yarns 3 and 6, respectively. A side of each pocket is also defined by a weft knuckle WFK that forms part of the bottom surface of the same pocket. For example, weft knuckle WFK of weft yarn 5 defines a side of pocket P5 where it passes over warp yarn 3 and forms part of the bottom surface of pocket P5 where it passes over warp yarn 4.

By way of non-limiting example, the parameters of the structured fabric shown in FIGS. 1-3 can have a mesh (number of warp yarns per inch) of 42 and a count (number of weft yarns per inch) of 36. The fabric can have a caliper of about 0.045 inches. The number of pockets per square inch is preferably in the range of 150-200. The depth of pockets, which is the distance between the upper plane and the lower plane of the fabric, is preferably between 0.07 mm and 0.60 mm. The fabric has an upper plane contact area of 10% or higher, preferably 15% or higher, and more preferably 20% depending upon the particular product being made. The top surface may also be hot calendered to increase the flatness of the fabric and the upper plane contact area. In addition, the single or multi-layered fabric should have a permeability value of between approximately 400 cfm and approximately 600 cfm, and is preferably between approximately 450 cfm and approximately 550 cfm.

Regarding yarn dimensions, the particular size of the yarns is typically governed by the mesh of the papermaking surface. In a typical embodiment of the fabric disclosed herein, the diameter of the warp and weft yarns can be between about 0.30 mm and 0.50 mm. The diameter of the warp yarns can be about 0.45 mm, is preferably about 0.40 mm, and is most preferably about 0.35 mm. The diameter of the weft yarns can be about 0.50 mm, is preferably about 0.45 mm, and is most preferably about 0.41 mm. Those of skill in the art will appreciate that yarns having diameters outside the above ranges may be used in certain applications. In one embodiment of the present invention, the warp and weft yarns can have diameters of between about 0.30 mm and 0.50 mm. Fabrics employing these yarn sizes may be implemented with polyester yarns or with a combination of polyester and nylon yarns.

The woven single or multi-layered fabric may utilize hydrolysis and/or heat resistant materials. Hydrolysis resistant materials should preferably include a PET monofilament having an intrinsic viscosity value normally associated with dryer and TAD fabrics in the range of between 0.72 IV (Intrinsic Velocity, i.e., a dimensionless number used to correlate the molecular weight of a polymer; the higher the number the higher the molecular weight) and approximately 1.0 IV. Hydrolysis resistant materials should also preferably have a suitable "stabilization package" which including carboxyl end group equivalents, as the acid groups catalyze hydrolysis and residual DEG or di-ethylene glycol as this too can increase the rate of hydrolysis. These two factors separate the resin which can be used from the typical PET bottle resin. For hydrolysis, it has been found that the carboxyl equivalent should be as low as possible to begin with, and should be less than approximately 12. Even at this low level of carboxyl end groups an end capping agent may be added, and may utilize a carbodiimide during extrusion to ensure that at the end of the process there are no free carboxyl groups. There are several chemical classes that can be used to cap the end groups such as epoxies, ortho-esters, and isocyanates, but in practice monomeric and combinations of monomeric and polymeric carbodiimides are preferred.

Heat resistant materials such as PPS can be utilized in the structured fabric. Other materials such as PEN, PST, PEEK and PA can also be used to improve properties of the fabric such as stability, cleanliness and life. Both single polymer yarns and copolymer yarns can be used. The yarns for the fabric need not necessarily be monofilament yarns and can be a multi-filament yarns, twisted multi-filament yarns, twisted monofilament yarns, spun yarns, core and sheath yarns, or any combination thereof, and could also be a non-plastic material, i.e., a metallic material. Similarly, the fabric may not necessarily be made of a single material and can be made of two, three or more different materials. Shaped yarns, i.e., non-circular yarns such as round, oval or flat yarns, can also be utilized to enhance or control the topography or properties of the paper sheet. Shaped yarns can also be utilized to improve or control fabric characteristics or properties such as stability, caliper, surface contact area, surface planarity, permeability and wearability. In addition, the yarns may be of any color.

The structured fabric can also be treated and/or coated with an additional polymeric material that is applied by, e.g., deposition. The material can be added cross-linked during processing in order to enhance fabric stability, contamination resistance, drainage, wearability, improve heat and/or hydrolysis resistance and in order to reduce fabric surface tension. This aids in sheet release and/or reduced drive loads. The treatment/coating can be applied to impart/improve one or several of these properties of the fabric. As indicated previously, the topographical pattern in the paper web can be changed and manipulated by use of different single and multi-layer weaves. Further enhancement of the pattern can be attained by adjustments to the specific fabric weave by changes to the yarn diameter, yarn counts, yarn types, yarn shapes, permeability, caliper and the addition of a treatment or coating etc. In addition, a printed design, such as a screen printed design, of polymeric material can be applied to the fabric to enhance its ability to impart an aesthetic pattern into the web or to enhance the quality of the web. Finally, one or more surfaces of the fabric or molding belt can be subjected to sanding and/or abrading in order to enhance surface characteristics. Referring to FIG. 1, the upper plane of the fabric may be sanded, ground, or abraded in such a manner, resulting in flat oval shaped areas on the warp knuckles WPK and the weft knuckles WFK.

The characteristics of the individual yarns utilized in the fabric of the present invention can vary depending upon the desired properties of the final papermakers' fabric. For example, the materials comprising yarns employed in the fabric of the present invention may be those commonly used in papermakers' fabric. As such, the yarns may be formed of polypropylene, polyester, nylon, or the like. The skilled artisan should select a yarn material according to the particular application of the final fabric.

By way of non-limiting example, the structured fabric can be a single or multi-layered woven fabric which can withstand high pressures, heat, moisture concentrations, and which can achieve a high level of water removal and also mold or emboss the paper web. These characteristics provide a structured fabric appropriate for the Voith ATMOS™ papermaking process. The fabric preferably has a width stability and a suitable high permeability and preferably utilizes hydrolysis and/or temperature resistant materials, as discussed above. The fabric is preferably a woven fabric that can be installed on an ATMOS™ machine as a pre-joined and/or seamed continuous and/or endless belt. Alternatively, the forming fabric can be joined in the ATMOS™ machine using, e.g., a pin-seam arrangement or can otherwise be seamed on the machine.

Figure 4:
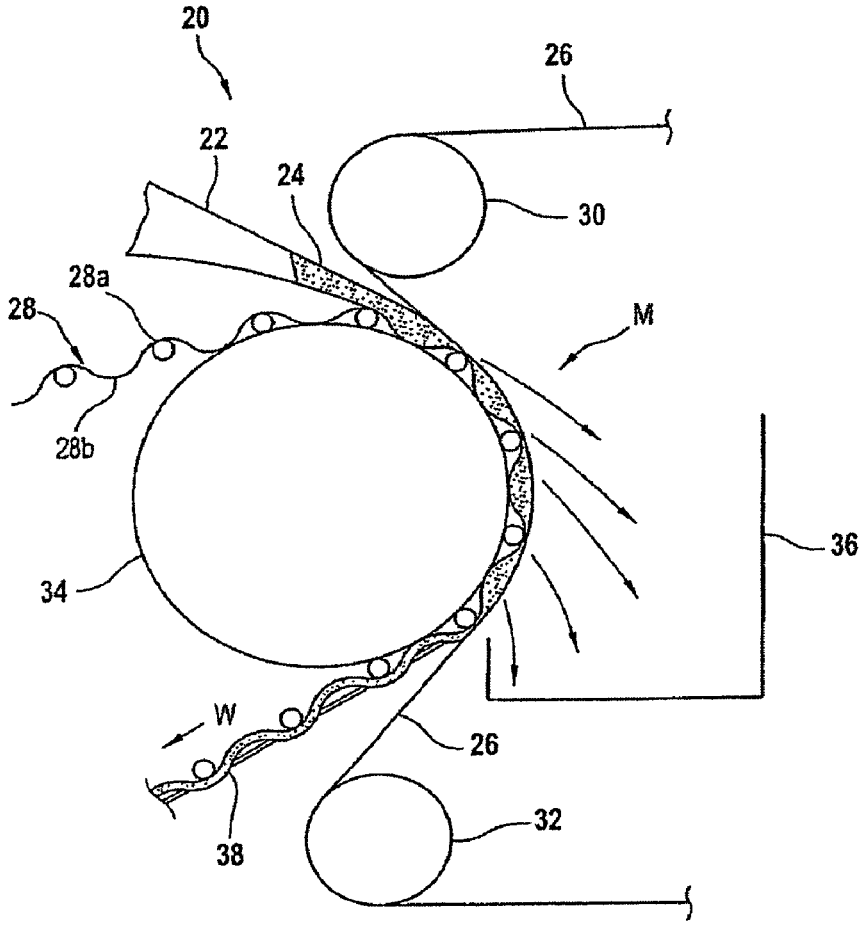
FIG. 4 is a cross-sectional diagram illustrating the formation of a structured web using an embodiment of the present invention.

The invention also provides for utilizing the structured fabric disclosed herein on a machine for making a fibrous web, e.g., tissue or hygiene paper web, etc., which can be, e.g., a twin wire ATMOS™ system. Referring again to the drawings, and more particularly to FIG. 4, there is a fibrous web machine 20 including a headbox 22 that discharges a fibrous slurry 24 between a forming fabric 26 and structured fabric 28. It should be understood that structured fabric 28 is the structured fabric discussed above in connection with FIGS. 1-3. Rollers 30 and 32 direct fabric 26 in such a manner that tension is applied thereto, against slurry 24 and structured fabric 28. Structured fabric 28 is supported by forming roll 34 which rotates with a surface speed that matches the speed of structured fabric 28 and forming fabric 26. Structured fabric 28 has peaks 28*a* and valleys 28*b*, which give a corresponding structure to web 38 formed thereon. Peaks 28*a* and valleys 28*b* generally represent the shape of the fabric due to the upper plane, the lower plane, and the pockets of the structured fabric as discussed above. Structured fabric 28 travels in direction W, and as moisture M is driven from fibrous slurry 24, structured fibrous web 38 takes form. Moisture M that leaves slurry 24 travels through forming fabric 26 and is collected in save-all 36. Fibers in fibrous slurry 24 collect predominately in valleys 28*b* as web 38 takes form.

Forming roll 34 is preferably solid. Moisture travels through forming fabric 26 but not through structured fabric 28. This advantageously forms structured fibrous web 38 into a more bulky or absorbent web than the prior art.

Figure 5:
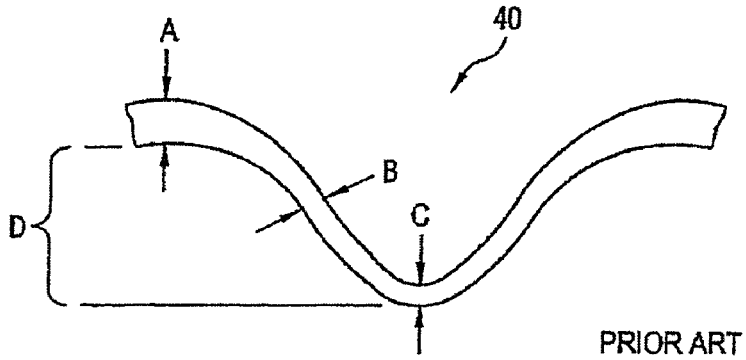
FIG. 5 is a cross-sectional view of a portion of a structured web of a prior art method.

In prior art methods of moisture removal, moisture is removed through a structured fabric by way of negative pressure. This results in a cross-sectional view of a fibrous web 40 as seen in FIG. 5. Prior art fibrous web 40 has a pocket depth D which corresponds to the dimensional difference between a valley and a peak. The valley is located at the point where measurement C is located and the peak is located at the point where measurement A is located. A top surface thickness A is formed in the prior art method. Sidewall dimension B and pillow thickness C of the prior art result from moisture drawn through a structured fabric. Dimension B is less than dimension A and dimension C is less than dimension B in the prior art web.

Figure 6:
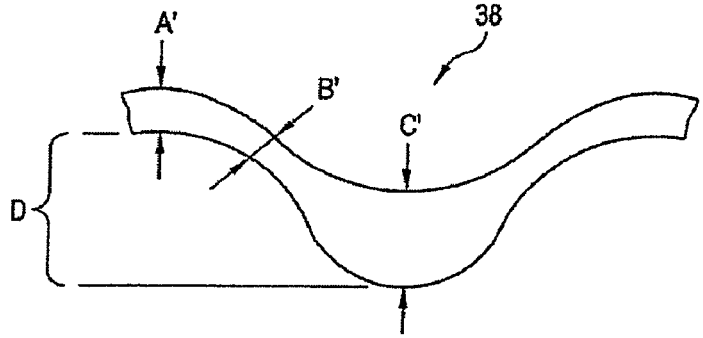
FIG. 6 is a cross-sectional view of a portion of the structured web of an embodiment of the present invention as made on the machine of FIG. 4.
Figure 7:
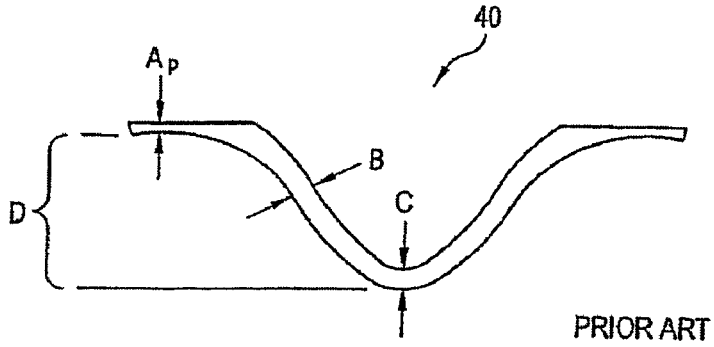
FIG. 7 illustrates the web portion of FIG. 5 having subsequently gone through a press drying operation.
Figure 8:
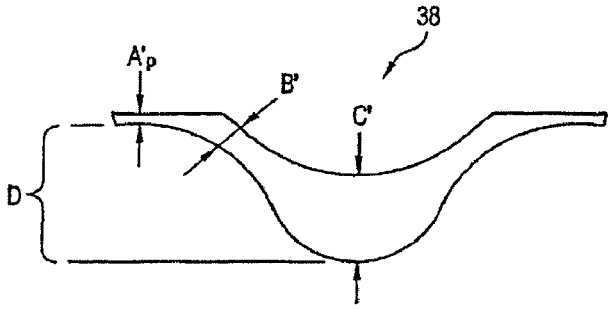
FIG. 8 illustrates a portion of the fiber web of the present invention of FIG. 6 having subsequently gone through a press drying operation.

In contrast, structured fibrous web 38, as illustrated in FIGS. 6 and 8, have for discussion purposes, a pocket depth D that is similar to the prior art. However, sidewall thickness B' and pillow thickness C' exceed the comparable dimensions of web 40. This advantageously results from the forming of structured fibrous web 38 on structured fabric 28 at low consistency and the removal of moisture is an opposite direction from the prior art. This results in a thicker pillow dimension C'. Even after structured fibrous web 38 goes through a drying press operation, as illustrated in FIG. 8, dimension C' is substantially greater than $A_P$'. As illustrated in FIG. 7, this is in contrast to the dimension C of the prior art. Advantageously, the fiber web resulting from the present invention has a higher basis weight in the pillow areas as compared to the prior art. Also, the fiber-to-fiber bonds are not broken as they can be in impression operations, which expand the web into the valleys.

According to the prior art, an already formed web is vacuum transferred into a structured fabric. The sheet must then expand to fill the contour of the structured fabric. In doing so, fibers must move apart. Thus the basis weight is lower in these pillow areas and therefore the thickness is less than the sheet at point A.

Figure 9:
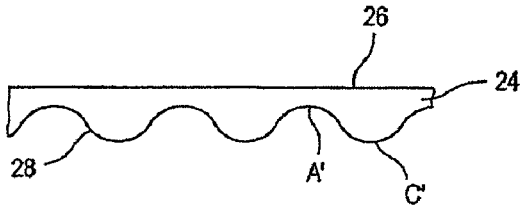
FIG. 9 illustrates a resulting fiber web of the forming section of the present invention.

Now, referring to FIGS. 9 to 14 the process will be explained by simplified schematic drawings. As shown in FIG. 9, fibrous slurry 24 is formed into a web 38 with a structure that matches the shape of structured fabric 28. Forming fabric 26 is porous and allows moisture to escape during forming. Further, water is removed as shown in FIG. 11, through dewatering fabric 82. The removal of moisture through fabric 82 does not cause compression of pillow areas C' in the web, since pillow areas C' reside in valleys 28*b* of structured fabric 28.

Figure 10:
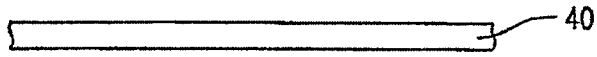
Fig. 10 PRIOR ART
FIG. 10 illustrates the resulting fiber web of the forming section of a prior art method.
Figure 11:
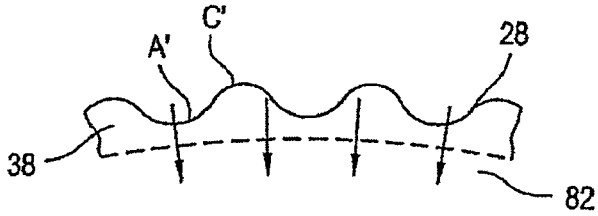
FIG. 11 illustrates the moisture removal of the fiber web of the present invention.

The prior art web shown in FIG. 10 is formed between two conventional forming fabrics in a twin wire former and is characterized by a flat uniform surface. It is this fiber web that is given a three-dimensional structure by a wet shaping stage, which results in the fiber web that is shown in FIG. 5. A conventional tissue machine that employs a conventional press fabric will have a contact area approaching 100%. Normal contact area of the structured fibrous web, as in this present invention, or as on a TAD machine, is typically much lower than that of a conventional machine; it is in the range of 15 to 35% depending on the particular pattern of the product being made.

Figure 12:
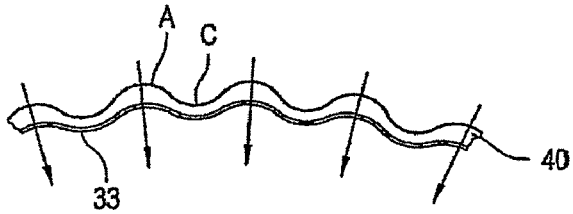
Fig. 12 PRIOR ART
FIG. 12 illustrates the moisture removal of the fiber web of a prior art structured web.
Figure 13:
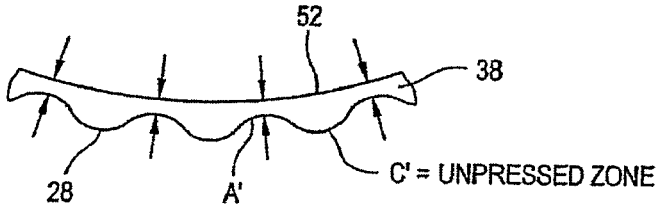
FIG. 13 illustrates the pressing points on a fiber web of the present invention.
Figure 14:
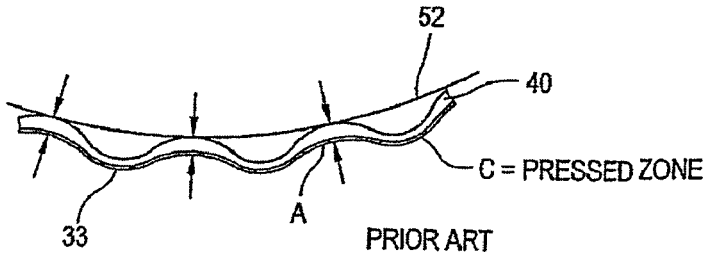
FIG. 14 illustrates pressing point of prior art structured web.

In FIGS. 12 and 14 a prior art web structure is shown where moisture is drawn through a structured fabric 33 causing the web, as shown in FIG. 5, to be shaped and causing pillow area C to have a low basis weight as the fibers in the web are drawn into the structure. The shaping can be done by performing pressure or underpressure to the web 40 forcing the web to follow the structure of the structured fabric 33. This additionally causes fiber tearing as they are moved into pillow area C. Subsequent pressing at the Yankee dryer 52, as shown in FIG. 14, further reduces the basis weight in area C. In contrast, water is drawn through dewatering fabric 82 in the present invention, as shown in FIG. 11, preserving pillow areas C'. Pillow areas C' of FIG. 13 are unpressed zones which are supported on structured fabric 28 while pressed against Yankee dryer 52. Pressed zone A' is the area through which most of the pressure is applied. Pillow area C' has a higher basis weight than that of the illustrated prior art structures.

The increased mass ratio of the present invention, particularly the higher basis weight in the pillow areas carries more water than the compressed areas, resulting in at least two positive aspects of the present invention over the prior art, as illustrated in FIGS. 11 and 13. First, it allows for a good transfer of the web 38 to the Yankee surface 52, since the web 38 has a relatively lower basis weight in the portion that comes in contact with the Yankee surface 52, at a lower overall sheet solid content than had been previously attainable, because of the lower mass of fibers that comes in contact with the Yankee dryer 52. The lower basis weight means that less water is carried to the contact points with the Yankee dryer 52. The compressed areas are dryer than the pillow areas, thereby allowing an overall transfer of the web to another surface, such as a Yankee dryer 52, with a lower overall web solids content. Secondly, the construct allows for the use of higher temperatures in the Yankee hood 54 without scorching or burning of the pillow areas, which occurs in the prior art pillow areas. The Yankee hood 54 temperatures are often greater than 350° C., preferably greater than 450° C., and even more preferably greater than 550° C. As a result the present invention can operate at lower average pre-Yankee press solids than the prior art, making more full use of the capacity of the Yankee hood drying system. The present invention allows the solids content of web 38 prior to the Yankee dryer 52 to run at less than 40%, less than 35% and even as low as 25%.

Due to the formation of the web 38 with the structured fabric 28 the pockets of the fabric 28 are fully filled with fibers. Therefore, at the Yankee surface 52 the web 38 has a much higher contact area, up to approximately 100%, as compared to the prior art because the web 38 on the side contacting the Yankee surface 52 is almost flat. At the same time the pillow areas C' of the web 38 are maintained unpressed, because they are protected by the valleys of the structured fabric 28 (FIG. 13). Good results in drying efficiency were obtained only pressing 25% of the web.

As can be seen in FIG. 14 the contact area of the prior art web 40 to the Yankee surface 52 is much lower as compared to the one of the web 38 manufactured according to the invention. The lower contact area of the prior art web 40 results from shaping the web 40 by drawing water out of the web 40 through structured fabric 33. Drying efficiency of the prior art web 40 is less than that of the web 38 of the present invention because the area of the prior art web 40 is in less contact with the Yankee surface 52.

Figure 15:
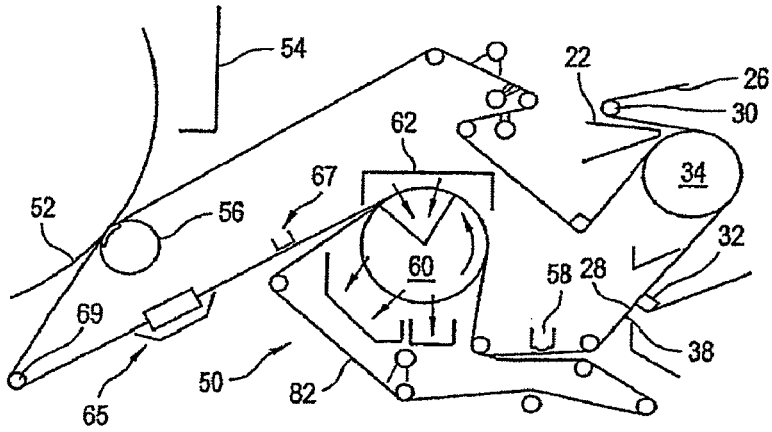
FIG. 15 illustrates a schematic cross-sectional view of an embodiment of an ATMOS™ papermaking machine.

Referring to FIG. 15, there is shown an embodiment of the process where a structured fibrous web 38 is formed. Structured fabric 28 carries a three dimensional structured fibrous web 38 to an advanced dewatering system 50, past vacuum box 67 and then to a position where the web is transferred to Yankee dryer 52 and hood section 54 for additional drying and creping before winding up on a reel (not shown).

A shoe press 56 is placed adjacent to structured fabric 28, holding fabric 28 in a position proximate Yankee dryer 52. Structured fibrous web 38 comes into contact with Yankee dryer 52 and transfers to a surface thereof, for further drying and subsequent creping.

A vacuum box 58 is placed adjacent to structured fabric 28 to achieve a solids level of 15-25% on a nominal 20 gsm web running at −0.2 to −0.8 bar vacuum with a preferred operating level of −0.4 to −0.6 bar. Web 38, which is carried by structured fabric 28, contacts dewatering fabric 82 and proceeds toward vacuum roll 60. Vacuum roll 60 operates at a vacuum level of −0.2 to −0.8 bar with a preferred operating level of at least −0.4 bar. Hot air hood 62 is optionally fit over vacuum roll 60 to improve dewatering. If, for example, a commercial Yankee drying cylinder with 44 mm steel thickness and a conventional hood with an air blowing speed of 145 m/s is used, production speeds of 1400 m/min or more for towel paper and 1700 m/min or more for toilet paper are used.

Optionally a steam box can be installed instead of the hood 62 supplying steam to the web 38. The steam box preferably has a sectionalized design to influence the moisture re-dryness cross profile of the web 38. The length of the vacuum zone inside the vacuum roll 60 can be from 200 mm to 2,500 mm, with a preferable length of 300 mm to 1,200 mm and an even more preferable length of between 400 mm to 800 mm. The solids level of web 38 leaving suction roll 60 is 25% to 55% depending on installed options. A vacuum box 67 and hot air supply 65 can be used to increase web 38 solids after vacuum roll 60 and prior to Yankee dryer 52. Wire turning roll 69 can also be a suction roll with a hot air supply hood. As discussed above, roll 56 includes a shoe press with a shoe width of 80 mm or higher, preferably 120 mm or higher, with a maximum peak pressure of less than 2.5 MPa. To create an even longer nip to facilitate the transfer of web 38 to Yankee dryer 52, web 38 carried on structured fabric 28 can be brought into contact with the surface of Yankee dryer 52 prior to the press nip associated with shoe press 56. Further, the contact can be maintained after structured fabric 28 travels beyond press 56.

Dewatering fabric 82 may have a permeable woven base fabric connected to a batt layer. The base fabric includes machine direction yarns and cross-direction yarns. The machine direction yarn is a three-ply multi-filament twisted yarn. The cross-direction yarn is a monofilament yarn. The machine direction yarn can also be a monofilament yarn and the construction can be of a typical multilayer design. In either case, the base fabric is needled with a fine batt fiber having a weight of less than or equal to 700 gsm, preferably less than or equal to 150 gsm, and more preferably less than or equal to 135 gsm. The batt fiber encapsulates the base structure giving it sufficient stability. The sheet contacting surface is heated to improve its surface smoothness. The cross-sectional area of the machine direction yarns is larger than the cross-sectional area of the cross-direction yarns. The machine direction yarn is a multi-filament yarn that may include thousands of fibers. The base fabric is connected to a batt layer by a needling process that results in straight through drainage channels.

In another embodiment of dewatering fabric 82, there is included a fabric layer, at least two batt layers, an anti-rewetting layer, and an adhesive. The base fabric is substantially similar to the previous description. At least one of the batt layers includes a low melt bi-compound fiber to supplement fiber-to-fiber bonding upon heating. On one side of the base fabric, there is attached an anti-rewetting layer, which may be attached to the base fabric by an adhesive, a melting process, or needling wherein the material contained in the anti-rewetting layer is connected to the base fabric layer and a batt layer. The anti-rewetting layer is made of an elastomeric material thereby forming an elastomeric membrane, which has openings there through.

The batt layers are needled to thereby hold dewatering fabric 82 together. This advantageously leaves the batt layers with many needled holes there through. The anti-rewetting layer is porous having water channels or straight through pores there through.

In yet another embodiment of dewatering fabric 82, there is a construct substantially similar to that previously discussed with an addition of a hydrophobic layer to at least one side of dewatering fabric 82. The hydrophobic layer does not absorb water, but it does direct water through pores therein.

In yet another embodiment of dewatering fabric 82, the base fabric has attached thereto a lattice grid made of a polymer, such as polyurethane, that is put on top of the base fabric. The grid may be put on to the base fabric by utilizing various known procedures, such as, for example, an extrusion technique or a screen-printing technique. The lattice grid may be put on the base fabric with an angular orientation relative to the machine direction yarns and the cross-direction yarns. Although this orientation is such that no part of the lattice is aligned with the machine direction yarns, other orientations can also be utilized. The lattice can have a uniform grid pattern, which can be discontinuous in part. Further, the material between the interconnections of the lattice structure may take a circuitous path rather than being substantially straight. The lattice grid is made of a synthetic, such as a polymer or specifically a polyurethane, which attaches itself to the base fabric by its natural adhesion properties.

In yet another embodiment of dewatering fabric 82, there is included a permeable base fabric having machine direction yarns and cross-direction yarns that are adhered to a grid. The grid is made of a composite material the may be the same as that discussed relative to a previous embodiment of dewatering fabric 82. The grid includes machine direction yarns with a composite material formed there around. The grid is a composite structure formed of composite material and machine direction yarns. The machine direction yarns may be pre-coated with a composite before being placed in rows that are substantially parallel in a mold that is used to reheat the composite material causing it to re-flow into a pattern. Additional composite material may be put into the mold as well. The grid structure, also known as a composite layer, is then connected to the base fabric by one of many techniques including laminating the grid to the permeable fabric, melting the composite coated yarn as it is held in position against the permeable fabric or by re-melting the grid onto the base fabric. Additionally, an adhesive may be utilized to attach the grid to the permeable fabric.

The batt layer may include two layers, an upper and a lower layer. The batt layer is needled into the base fabric and the composite layer, thereby forming a dewatering fabric 82 having at least one outer batt layer surface. Batt material is porous by its nature, and additionally the needling process not only connects the layers together, but it also creates numerous small porous cavities extending into or completely through the structure of dewatering fabric 82.

Dewatering fabric 82 has an air permeability of from 5 to 100 cfm, preferably 19 cfm or higher, and more preferably 35 cfm or higher. Mean pore diameters in dewatering fabric 82 are from 5 to 75 microns, preferably 25 microns or higher, and more preferably 35 microns or higher. The hydrophobic layers can be made from a synthetic polymeric material, a wool or a polyamide, for example, nylon 6. The anti-rewetting layer and the composite layer may be made of a thin elastomeric permeable membrane made from a synthetic polymeric material or a polyamide that is laminated to the base fabric.

The batt fiber layers are made from fibers ranging from 0.5 d-tex to 22 d-tex and may contain a low melt bi-compound fiber to supplement fiber-to-fiber bonding in each of the layers upon heating. The bonding may result from the use of a low temperature meltable fiber, particles and/or resin. The dewatering fabric can be less than 2.0 mm thick.

Preferred embodiments of the dewatering fabric 82 are also described in the PCT/EP2004/053688 and PCT/EP2005/050198 which are herewith incorporated by reference.

Figure 16:
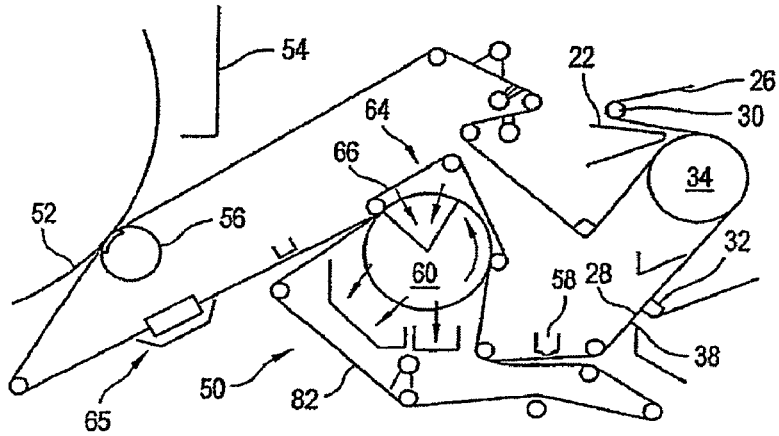
FIG. 16 illustrates a schematic cross-sectional view of another embodiment of an ATMOS™ papermaking machine.

Now, additionally referring to FIG. 16, there is shown yet another embodiment of the present invention, which is substantially similar to the invention illustrated in FIG. 15, except that instead of hot air hood 62, there is a belt press 64. Belt press 64 includes a permeable belt 66 capable of applying pressure to the machine side of structured fabric 28 that carries web 38 around vacuum roll 60. Fabric 66 of belt press 64 is also known as an extended nip press belt or a link fabric, which can run at 60 KN/m fabric tension with a pressing length that is longer than the suction zone of roll 60.

Preferred embodiments of the fabric 66 and the required operation conditions are also described in PCT/EP2004/053688 and PCT/EP2005/050198 which are herewith incorporated by reference.

The above mentioned references are also fully applicable for dewatering fabrics 82 and press fabrics 66 described in the further embodiments.

While pressure is applied to structured fabric 28 by belt press 64, the high fiber density pillow areas in web 38 are protected from that pressure as they are contained within the body of structured fabric 28, as they are in the Yankee nip.

Belt 66 is a specially designed extended nip press belt 66, made of, for example reinforced polyurethane and/or a spiral link fabric. Belt 66 also can have a woven construction. Such a woven construction is disclosed, e.g., in EP 1837439. Belt 66 is permeable thereby allowing air to flow there through to enhance the moisture removing capability of belt press 64. Moisture is drawn from web 38 through dewatering fabric 82 and into vacuum roll 60.

Belt 66 provides a low level of pressing in the range of 50-300 KPa and preferably greater than 100 KPa. This allows a suction roll with a 1.2 m diameter to have a fabric tension of greater than 30 KN/m and preferably greater than 60 KN/m. The pressing length of permeable belt 66 against fabric 28, which is indirectly supported by vacuum roll 60, is at least as long as a suction zone in roll 60. However, the contact portion of belt 66 can be shorter than the suction zone.

Permeable belt 66 has a pattern of holes there through, which may, for example, be drilled, laser cut, etched formed or woven therein. Permeable belt 66 may be monoplanar without grooves. In one embodiment, the surface of belt 66 has grooves and is placed in contact with fabric 28 along a portion of the travel of permeable belt 66 in belt press 64. Each groove connects with a set of the holes to allow the passage and distribution of air in belt 66. Air is distributed along the grooves, which constitutes an open area adjacent to contact areas, where the surface of belt 66 applies pressure against web 38. Air enters permeable belt 66 through the holes and then migrates along the grooves, passing through fabric 28, web 38 and fabric 82. The diameter of the holes may be larger than the width of the grooves. The grooves may have a cross-section contour that is generally rectangular, triangular, trapezoidal, semi-circular or semi-elliptical. The combination of permeable belt 66, associated with vacuum roll 60, is a combination that has been shown to increase sheet solids by at least 15%.

An example of another structure of belt 66 is that of a thin spiral link fabric, which can be a reinforcing structure within belt 66 or the spiral link fabric will itself serve as belt 66. Within fabric 28 there is a three dimensional structure that is reflected in web 38. Web 38 has thicker pillow areas, which are protected during pressing as they are within the body of structured fabric 28. As such the pressing imparted by belt press 64 upon web 38 does not negatively impact web quality, while it increases the dewatering rate of vacuum roll 60.

Figure 17:
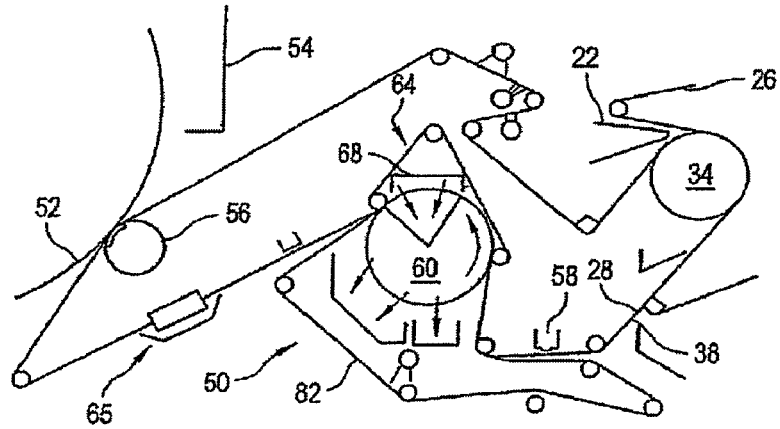
FIG. 17 illustrates a schematic cross-sectional view of another embodiment of an ATMOS™ papermaking machine.

Referring to FIG. 17, there is shown another embodiment of the present invention which is substantially similar to the embodiment shown in FIG. 16 with the addition of hot air hood 68 placed inside of belt press 64 to enhance the dewatering capability of belt press 64 in conjunction with vacuum roll 60.

Figure 18:
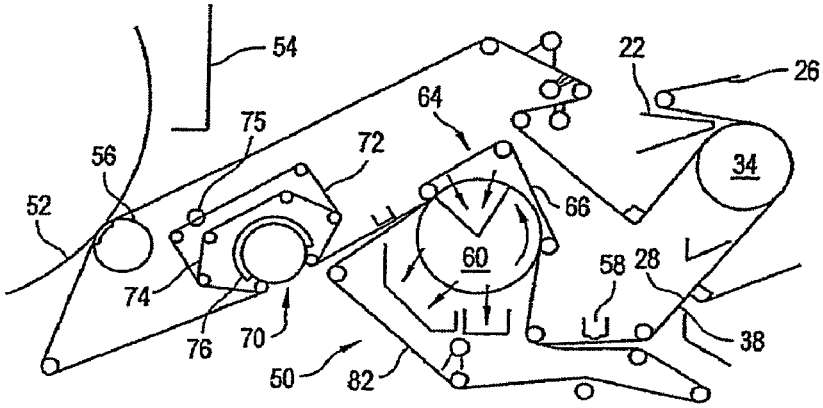
FIG. 18 illustrates a schematic cross-sectional view of another embodiment of an ATMOS™ papermaking machine.

Referring to FIG. 18, there is shown yet another embodiment of the present invention, which is substantially similar to the embodiment shown in FIG. 16, but including a boost dryer 70 which encounters structured fabric 28. Web 38 is subjected to a hot surface of boost dryer 70, and structured web 38 rides around boost dryer 70 with another woven fabric 72 riding on top of structured fabric 28. On top of woven fabric 72 is a thermally conductive fabric 74, which is in contact with both woven fabric 72 and a cooling jacket 76 that applies cooling and pressure to all fabrics and web 38. Here again, the higher fiber density pillow areas in web 38 are protected from the pressure as they are contained within the body of structured fabric 28. As such, the pressing process does not negatively impact web quality. The drying rate of boost dryer 70 is above 400 kg/hr·m$^2$ and preferably above 500 kg/hr·m$^2$. The concept of boost dryer 70 is to provide sufficient pressure to hold web 38 against the hot surface of the dryer thus preventing blistering. Steam that is formed at the knuckle points of fabric 28 passes through fabric 28 and is condensed on fabric 72. Fabric 72 is cooled by fabric 74 that is in contact with cooling jacket 76, which reduces its temperature to well below that of the steam. Thus the steam is condensed to avoid a pressure build up to thereby avoid blistering of web 38. The condensed water is captured in woven fabric 72, which is dewatered by dewatering device 75. It has been shown that depending on the size of boost dryer 70, the need for vacuum roll 60 can be eliminated. Further, depending on the size of boost dryer 70, web 38 may be creped on the surface of boost dryer 70, thereby eliminating the need for Yankee dryer 52.

Figure 19:
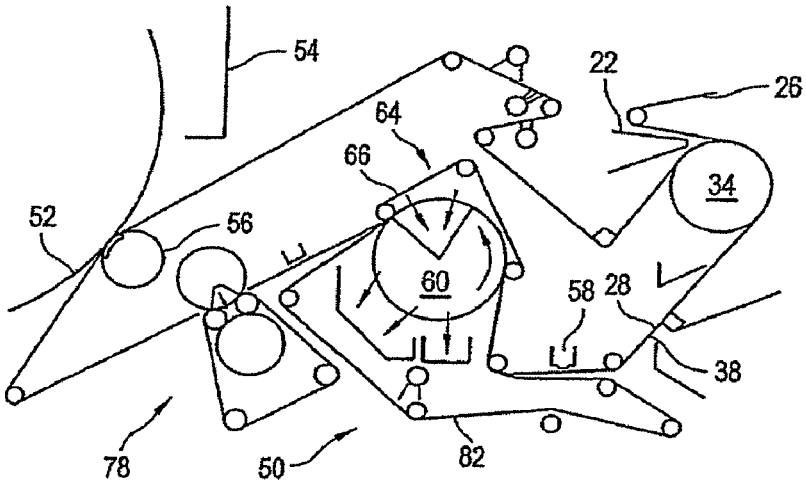
FIG. 19 illustrates a schematic cross-sectional view of another embodiment of an ATMOS™ papermaking machine.

Referring to FIG. 19, there is shown yet another embodiment of the present invention substantially similar to the invention disclosed in FIG. 16 but with an addition of an air press 78, which is a four roll cluster press that is used with high temperature air and is referred to as an HPTAD for additional web drying prior to the transfer of web 38 to Yankee dryer 52. Four roll cluster press 78 includes a main roll, a vented roll, and two cap rolls. The purpose of this cluster press is to provide a sealed chamber that is capable of being pressurized. The pressure chamber contains high temperature air, for example, 150° C. or higher and is at a significantly higher pressure than conventional TAD technology, for example, greater than 1.5 psi resulting in a much higher drying rate than a conventional TAD. The high pressure hot air passes through an optional air dispersion fabric, through web 38 and fabric structured 28 into a vent roll. The air dispersion fabric may prevent web 38 from following one of the cap rolls. The air dispersion fabric is very open, having a permeability that equals or exceeds that of fabric structured 28. The drying rate of the HPTAD depends on the solids content of web 38 as it enters the HPTAD. The preferred drying rate is at least 500 kg/hr·m$^2$, which is a rate of at least twice that of conventional TAD machines.

Advantages of the HPTAD process are in the areas of improved sheet dewatering without a significant loss in sheet quality and compactness in size and energy efficiency. Additionally, it enables higher pre-Yankee solids, which increase the speed potential of the invention. Further, the compact size of the HPTAD allows for easy retrofitting to an existing machine. The compact size of the HPTAD and the fact that it is a closed system means that it can be easily insulated and optimized as a unit to increase energy efficiency.

Figure 20:
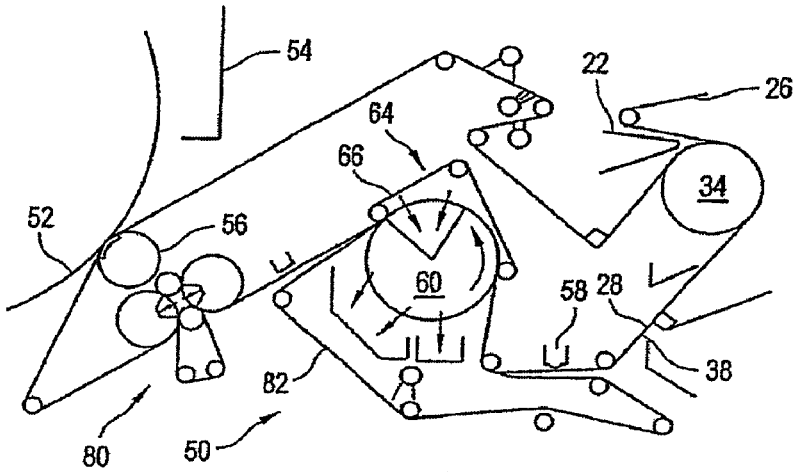
FIG. 20 illustrates a schematic cross-sectional view of another embodiment of an ATMOS™ papermaking machine.

Referring to FIG. 20, there is shown another embodiment of the present invention. This is significantly similar to the embodiments shown in FIGS. 16 and 19 except for the addition of a two-pass HPTAD 80. In this case, two vented rolls are used to double the dwell time of structured web 38 relative to the design shown in FIG. 19. An optional coarse mesh fabric may used as in the previous embodiment. Hot pressurized air passes through web 38 carried on structured fabric 28 and onto the two vent rolls. It has been shown that depending on the configuration and size of the HPTAD, more than one HPTAD can be placed in series, which can eliminate the need for roll 60.

Figure 21:
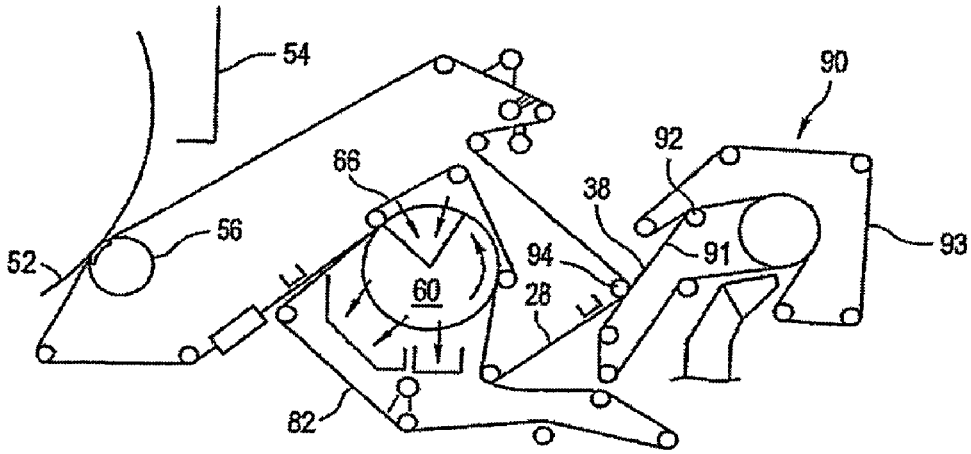
FIG. 21 illustrates a schematic cross-sectional view of another embodiment of an ATMOS™ papermaking machine.

Referring to FIG. 21, a conventional twin wire former 90 may be used to replace the crescent former shown in previous examples. The forming roll can be either a solid or open roll. If an open roll is used, care must be taken to prevent significant dewatering through the structured fabric to avoid losing basis weight in the pillow areas. The outer forming fabric 93 can be either a standard forming fabric or one such as that disclosed in U.S. Pat. No. 6,237,644. The inner fabric 91 should be a structured fabric that is much coarser than the outer forming fabric 90. For example, inner fabric 91 may be similar to structured fabric 28. A vacuum roll 92 may be needed to ensure that the web stays with structured fabric 91 and does not go with outer wire 90. Web 38 is transferred to structured fabric 28 using a vacuum device. The transfer can be a stationary vacuum shoe or a vacuum assisted rotating pick-up roll 94. The second structured fabric 28 is at least the same coarseness and preferably coarser than first structured fabric 91. The process from this point is the same as the process previously discussed in conjunction with FIG. 16. The registration of the web from the first structured fabric to the second structured fabric is not perfect, and as such some pillows will lose some basis weight during the expansion process, thereby losing some of the benefit of the present invention. However, this process option allows for running a differential speed transfer, which has been shown to improve some sheet properties. Any of the arrangements for removing water discussed above as may be used with the twin wire former arrangement and a conventional TAD.

Figure 22:
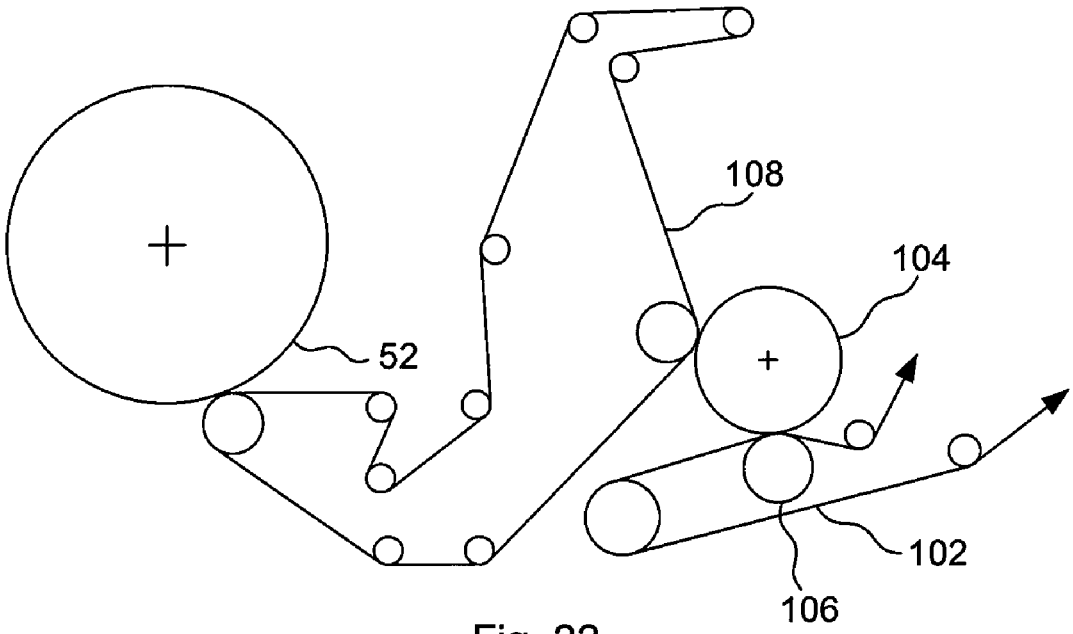
FIG. 22 illustrates a schematic cross-sectional view of an E-TAD papermaking machine.

Referring to FIG. 22, the components shown in previous examples may be replaced by a machine in which the web is not directly transferred between fabrics. This system is referred to as an E-TAD and includes a press felt 102 that originally carries a structured fibrous web. The web is transferred to a backing roll 104 at a shoe press 106. Backing roll 104 is preferably a dryer that carries the web without the assistance of a fabric over part of its surface. Backing roll 104 transfers the web to a transfer fabric 108 that may be the structured fabric discussed above in connection with FIGS. 1-3. This process allows for running a differential speed transfer between backing roll 104 and transfer fabric 108. Transfer fabric 108 subsequently transfers the web to Yankee dryer 52. Additional components may be added to the E-TAD system, such as other drying components as discussed with previous embodiments of the invention.

Although the structured fabric of the present invention is preferably used with a papermaking machine according to the previous discussion, the structured fabric may be used with a conventional TAD machine. TAD machines, as well as their operating characteristics and associated components, are well known in the art as for example from U.S. Pat. No. 4,191,609, hereby incorporated by reference in its entirety.

The fiber distribution of web 38 in this invention is opposite that of the prior art, which is a result of removing moisture through the forming fabric and not through the structured fabric. The low density pillow areas are of relatively high basis weight compared to the surrounding compressed zones, which is opposite of conventional TAD paper. This allows a high percentage of the fibers to remain uncompressed during the process. The sheet absorbency capacity as measured by the basket method, for a nominal 20 gsm web is equal to or greater than 12 grams water per gram of fiber and often exceeds 15 grams of water per gram fiber. The sheet bulk is equal to or greater than 10 $cm^3$/gm and preferably greater than 13 $cm^3$/gm. The sheet bulk of toilet tissue is expected to be equal to or greater than 13 $cm^3$/gm before calendering.

With the basket method of measuring absorbency, 5 grams of paper are placed into a basket. The basket containing the paper is then weighed and introduced into a small vessel of water at 20° C. for 60 seconds. After 60 seconds of soak time, the basket is removed from the water and allowed to drain for 60 seconds and then weighed again. The weight difference is then divided by the paper weight to yield the grams of water held per gram of fibers being absorbed and held in the paper.

As discussed above, web 38 is formed from fibrous slurry 24 that headbox 22 discharges between forming fabric 26 and structured fabric 28. Roll 34 rotates and supports fabrics 26 and 28 as web 38 forms. Moisture M flows through fabric 26 and is captured in save-all 36. It is the removal of moisture in this manner that serves to allow pillow areas of web 38 to retain a greater basis weight and therefore thickness than if the moisture was removed through structured fabric 28. Sufficient moisture is removed from web 38 to allow fabric 26 to be removed from web 38 to allow web 38 to proceed to a drying stage. As discussed above, web 38 retains the pattern of structured fabric 28 and, in addition, any zonal permeability effects from fabric 26 that may be present.

As slurry 24 comes from headbox 22 it has a very low consistency of approximately 0.1 to 0.5%. The consistency of web 38 increases to approximately 7% at the end of the forming section outlet. In some of the embodiments described above, structured fabric 28 carries web 38 from where it is first placed there by headbox 22 all the way to a Yankee dryer to thereby provide a well defined paper structure for maximum bulk and absorbency. Web 38 has exceptional caliper, bulk and absorbency, those parameters being about 30% higher than with a conventional TAD fabric used for producing paper towels. Excellent transfer of web 38 to the Yankee dryer takes place with the ATMOS™ system working at 33% to 37% dryness, which is a higher moisture content than the TAD of 60% to 75%. There is no dryness loss running in the ATMOS™ configuration since structured fabric 28 has pockets (valleys 28*b*), and there is no loss of intimacy between a dewatering fabric, web 38, structured fabric 28 and the belt.

The invention may be summarized as follows:

1. A fabric for a papermaking machine, comprising:

a machine facing side;

a web facing side comprising pockets formed by warp and weft yarns;

wherein each pocket is defined by four sides on the web facing side, three of the four sides each being formed by a knuckle of a single yarn, and one of the sides being formed by a knuckle of a weft and of a warp yarn, wherein the weft yarn also defines a bottom surface of the pocket.

2. The fabric of claim 1, wherein the weft yarn defines a knuckle that passes over five consecutive warp yarns.

3. The fabric of claim 1, wherein two of the sides are formed by second and third weft knuckles of single weft yarns, and one of the sides is formed by a second warp knuckle of a single warp yarn.

4. The fabric of claim 3, wherein the second warp knuckle has ends that are passed over by the second and third weft knuckles.

5. The fabric of claim 3, wherein each warp knuckle passes over two consecutive weft yarns, and each weft knuckle passes over five consecutive warp yarns.

6. The fabric of claim 1, wherein each weft knuckle forms sides of three separate pockets.

7. The fabric of claim 1, wherein the warp yarns and the weft yarns form a repeating weave pattern with a pattern square including ten weft yarns and ten warp yarns, and similar portions of the weave pattern between adjacent warp yarns are offset from each other by three weft yarns.

8. The fabric of claim 1, wherein the warp yarns and the weft yarns form a repeating weave pattern with a pattern square including ten weft yarns and ten warp yarns, each of the ten warp yarns having a pattern of passing under two consecutive weft yarns, passing over one weft yarn, passing under three consecutive weft yarns, passing over one weft yarn, passing under one weft yarn, and passing over two consecutive weft yarns.

9. The fabric of claim 1, wherein the pockets are arranged in an uninterrupted series that extends diagonally relative to the direction of the warp and weft yarns.

10. The fabric of claim 1, wherein the warp yarns are non-circular yarns.

11. A fabric for a papermaking machine, comprising:

a machine facing side;

a web facing side comprising pockets formed by warp and weft yarns;

wherein each pocket is defined by four sides on the web facing side, the first side being a weft knuckle that passes over five consecutive warp yarns, the second side being a warp knuckle of a fourth one of the five consecutive warp yarns passed over by the first side, the third side being a weft knuckle that passes over five consecutive warp yarns and the second side being a third one of the five consecutive warp yarns passed over by the third side, and the fourth side including a warp knuckle and a weft knuckle, the fourth side warp knuckle being a first one of the warp yarns passed over by the first side and the fourth side weft knuckle being a weft yarn that also defines a bottom surface of the pocket.

12. The fabric of claim 11, wherein the first side and the weft yarn that defines a bottom surface of the pocket are defined by adjacent weft yarns.

13. The fabric of claim 11, wherein the first side and the third side are defined by weft yarns that are separated by two weft yarns.

14. The fabric of claim 11, wherein each knuckle intersects three other knuckles.

15. A papermaking machine, comprising:

a vacuum roll having an exterior surface;

a dewatering fabric having first and second sides, the dewatering fabric being guided over a portion of the exterior surface of the vacuum roll, the first side being in at least partial contact with the exterior surface of the vacuum roll;

a structured fabric including:

a machine facing side;

a web facing side comprising pockets formed by warp and weft yarns;

wherein each pocket is defined by four sides on the web facing side, three of the four sides each being formed by a knuckle of a single yarn, and one of the sides being formed by a knuckle of a weft and of a warp yarn, wherein the weft yarn also defines a bottom surface of the pocket.

16. The papermaking machine of claim 15, further comprising a belt press including a permeable belt having a first side, the permeable belt being guided over a portion of the vacuum roll, and wherein the first side of the permeable belt is in at least partial contact with the machine facing side of the structured fabric.

17. The papermaking machine of claim 15, further comprising:

a forming roll having an exterior surface;

a forming fabric having first and second sides;

wherein the structured fabric is guided over a portion of the exterior surface of the forming roll, and the machine facing side of the structured fabric is in at least partial contact with the exterior surface of the forming roll, and the structured fabric is positioned between the forming roll and the forming fabric.

18. The papermaking machine of claim 17, wherein a fibrous web is formed between the web facing side of the structured fabric and the first side of the forming fabric.

19. The papermaking machine of claim 18, wherein the structured fabric transfers the fibrous web to a Yankee dryer.

20. A papermaking machine, comprising:

a Yankee dryer;

at least one structured fabric including:

a machine facing side;

a web facing side comprising pockets formed by warp and weft yarns;

wherein each pocket is defined by four sides on the web facing side, three of the four sides each being formed by a knuckle of a single yarn, and one of the sides being formed by a knuckle of a weft and of a warp yarn, wherein the weft yarn also defines a bottom surface of the pocket.

21. The papermaking machine of claim 20, wherein the machine further includes:

a forming roll having an exterior surface;

a forming fabric having first and second sides;

wherein the at least one structured fabric is guided over a portion of the exterior surface of the forming roll, and the machine facing side of the structured fabric is in at least partial contact with the exterior surface of the forming roll, and the at least one structured fabric is positioned between the forming roll and the forming fabric.

22. The papermaking machine of claim 20, wherein the machine further includes a backing roll, and wherein the at least one structured fabric is a transfer fabric between the backing roll and the Yankee dryer.

23. A method of subjecting a web to pressing in a paper machine using the fabric of claim 1, the method comprising:

forming a web; and applying pressure to the fabric and the web.

24. The method of claim 23, wherein the paper machine comprises one of:

a TAD system;

an ATMOS system; and an E-TAD system.

As explained above, the structured fabric imparts a topographical pattern into the paper sheet or web. To accomplish this, high pressures can be imparted to the fabric via the high tension belt. The topography of the sheet pattern can be manipulated by varying the specifications of the fabric, i.e., by regulating parameters such as, yarn diameter, yarn shape, yarn density, and yarn type. Different topographical patterns can be imparted in the sheet by different surface weaves. Similarly, the intensity of the sheet pattern can be varied by altering the pressure imparted by the high tension belt and by varying the specification of the fabric. Other factors which can influence the nature and intensity of the topographical pattern of the sheet include air temperature, air speed, air pressure, belt dwell time in the extended nip, and nip length.

It is noted that the foregoing examples have been provided merely for the purpose of explanation and are in no way to be construed as limiting of the present invention. While the present invention has been described with reference to exemplary embodiments, it should be understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular arrangements, materials and embodiments, the invention is not intended to be limited to the particulars disclosed herein. Instead, the invention extends to all functionally equivalent structures, methods and uses, such as are within the scope of the appended claims.

We claim:

1. A fabric for a papermaking machine, comprising:
a machine facing side;
a web facing side comprising pockets formed by warp and weft yarns;
wherein each pocket is defined by four sides on the web facing side, three of the four sides each being formed by a knuckle of a single yarn, and one of the sides being formed by a knuckle of a weft and of a warp yarn, wherein the weft yarn also defines a bottom surface of the pocket.

2. The fabric of claim 1, wherein the weft yarn defines a knuckle that passes over five consecutive warp yarns.

3. The fabric of claim 1, wherein the knuckle of the weft and of the warp yarn is a first weft/warp knuckle, two of the four sides are formed by second and third weft knuckles of single weft yarns, and one of the four sides is formed by a second warp knuckle of a single warp yarn.

4. The fabric of claim 3, wherein the second warp knuckle has ends that are passed over by the second and third weft knuckles.

5. The fabric of claim 3, wherein each warp knuckle passes over two consecutive weft yarns, and each weft knuckle passes over five consecutive warp yarns.

6. The fabric of claim 1, wherein each weft knuckle forms sides of three separate pockets.

7. The fabric of claim 1, wherein the warp yarns and the weft yarns form a repeating weave pattern with a pattern square including ten weft yarns and ten warp yarns, and similar portions of the weave pattern between adjacent warp yarns are offset from each other by three well yarns.

8. The fabric of claim 1, wherein the warp yarns and the well yarns form a repeating weave pattern with a pattern square including ten well yarns and ten warp yarns, each of the ten warp yarns having a pattern of passing under two consecutive well yarns, passing over one well yarn, passing under three consecutive well yarns, passing over one well yarn, passing under one well yarn, and passing over two consecutive well yarns.

9. The fabric of claim 1, wherein the pockets are arranged in an uninterrupted series that extends diagonally relative to the direction of the warp and weft yarns.

10. The fabric of claim 1, wherein the warp yarns are non-circular yarns.

11. A fabric for a papermaking machine, comprising:
a machine facing side;
a web facing side comprising pockets formed by warp and well yarns;
wherein each pocket is defined by four sides on the web facing side, the first side being a well knuckle that passes over five consecutive warp yarns, the second side being a warp knuckle of a fourth one of the five consecutive warp yarns passed over by the first side, the third side being a well knuckle that passes over five consecutive warp yarns and the second side being a third one of the five consecutive warp yarns passed over by the third side, and the fourth side including a warp knuckle and a well knuckle, the fourth side warp knuckle being a first one of the warp yarns passed over by the first side and the fourth side well knuckle being a well yarn that also defines a bottom surface of the pocket.

12. The fabric of claim 11, wherein the first side and the well yarn that defines a bottom surface of the pocket are defined by adjacent well yarns.

13. The fabric of claim 11, wherein the first side and the third side are defined by weft yarns that are separated by two weft yarns.

14. The fabric of claim 11, wherein each knuckle intersects three other knuckles.

15. A papermaking machine, comprising:
a vacuum roll having an exterior surface;
a dewatering fabric having first and second sides, the dewatering fabric being guided over a portion of the exterior surface of the vacuum roll, the first side being in at least partial contact with the exterior surface of the vacuum roll;
a structured fabric including:
a machine facing side;
a web facing side comprising pockets formed by warp and weft yarns;
wherein each pocket is defined by four sides on the web facing side, three of the four sides each being formed by a knuckle of a single yarn, and one of the sides being formed by a knuckle of a weft and of a warp yarn, wherein the weft yarn also defines a bottom surface of the pocket.

16. The papermaking machine of claim 15, further comprising a belt press including a permeable belt having a first side, the permeable belt being guided over a portion of the vacuum roll, and wherein the first side of the permeable belt is in at least partial contact with the machine facing side of the structured fabric.

17. The papermaking machine of claim 15, further comprising:
a forming roll having an exterior surface;
a forming fabric having first and second sides;
wherein the structured fabric is guided over a portion of the exterior surface of the forming roll, and the machine facing side of the structured fabric is in at least partial contact with the exterior surface of the forming roll, and the structured fabric is positioned between the forming roll and the forming fabric.

18. The papermaking machine of claim 17, wherein a fibrous web is formed between the web facing side of the structured fabric and the first side of the forming fabric.

19. The papermaking machine of claim 18, wherein the structured fabric transfers the fibrous web to a Yankee dryer.

* * * * *

UNITED STATES PATENT AND TRADEMARK OFFICE

CERTIFICATE OF CORRECTION

PATENT NO. : 8,114,254 B2
APPLICATION NO. : 12/182773
DATED : February 14, 2012
INVENTOR(S) : Scott Quigley It is certified that error appears in the above-identified patent and that said Letters Patent is hereby corrected as shown below:

Col. 23, Claim 7, line 39 change “well” to --weft--.

Col. 23, Claim 8, lines 41-47 change “well” to --weft--.

Col. 23, Claim 11, lines 56 and 58 change “well” to --weft--.

Col. 24, Claim 11, lines 4, 8, and 10 change “well” to --weft--.

Col. 24, Claim 12, lines 13 and 14 change “well” to --weft--.

Signed and Sealed this
Seventeenth Day of April, 2012

David J. Kappos

David J. Kappos
*Director of the United States Patent and Trademark Office*